United States Patent [19]

van Huuksloot

[11] 4,176,872

[45] Dec. 4, 1979

[54] GRAB OR THE LIKE

[75] Inventor: Leendert van Huuksloot, Zevenbergschen Hoek, Netherlands

[73] Assignee: Nemag, B.V., Rotterdam, Netherlands

[21] Appl. No.: 871,598

[22] Filed: Jan. 23, 1978

[30] Foreign Application Priority Data

Jan. 27, 1977 [NL] Netherlands ..... 7700847

[51] Int. Cl.[2] ..... E02F 3/44

[52] U.S. Cl. ..... 294/70; 37/187

[58] Field of Search ..... 294/70, 111, 112; 37/183 R, 183 A, 184, 185, 186, 187, 188; 214/656, 657, 658

[56] References Cited

U.S. PATENT DOCUMENTS

| | | | |
|---|---|---|---|
| 3,949,498 | 4/1976 | Iwata et al. | 294/70 |
| 4,047,313 | 9/1977 | Bricon | 294/70 |

FOREIGN PATENT DOCUMENTS

| | | | |
|---|---|---|---|
| 1172300 | 12/1958 | Fed. Rep. of Germany | 294/112 |

*Primary Examiner*—James B. Marbert

*Attorney, Agent, or Firm*—Stevens, Davis, Miller & Mosher

[57] ABSTRACT

A grab or the like substantially comprising a frame or upper structure having for each grab bucket pivoting levers, at the end of which there is positioned the pivot point of a grab bucket, while each grab bucket can furthermore be pulled by means of a rope to the opened position and via a lever system connected to a pulley block movable in the frame, into the closing position, whereby each grab bucket is connected through a pair of levers to a pulley block such that, in the opened position of the grab buckets, this can form an angle of 180°, while the grab buckets, in an intermediate position of the movable pulley block, sealingly abut against the lower and side boundary edges.

3 Claims, 3 Drawing Figures

GRAB OR THE LIKE

In the senior patent application No. 75,13279 of applicants there is described a grab which more in particular is developed for taking up and transporting powders and the like dry material that is easily dusty, and it is the object of the grab described to lift and transport the load without inconvenience to the surroundings, while furthermore minimizing air and other pollutions.

One of the essential features of the above mentioned construction is that the grab buckets can be rotated quite far so that the material can be lifted substantially without residue from a bottom or floor, while furthermore the material to be transported is accommodated in the grab buckets so that spilling and dusting is minimized.

However, it is possible with the construction in question that parts of the control mechanism come into contact with the material to be tansported, which may lead to pollutions and disturbances in the control system, while it is likewise possible that small quantities of the substance in question may pollute the environment as a result of wind or other weather influences. French Pat. No. 530,464 discloses a grab of the above described type in which the frame or upper structure for each grab bucket comprises bell crank levers, at the end of which is disposed the pivot point of a grab bucket, while each grab bucket is furthermore adapted to be urged by means of a rope to the opened position and via a lever system which is coupled to a pulley block movable in said frame, in the closed position. However this construction has the drawback that the material to be transported cannot be lifted without leaving residues, while furthermore parts of the suspension or control mechanism may come into contact with the material to be transported.

It is the object of the present invention to remove the above described drawbacks, which is possible in that each grab bucket is connected by a pair of levers to the pulley block so that in the opened position of the grab buckets it can form an angle of 180°, while the grab buckets, in the intermediate position of the movable pulley block, sealingly adjoin each other with the lower and side boundary edges.

Said intermediate position is a position wherein the grab buckets have taken up the material to be transported and since the lower and side boundary edges may adjoin each other sealingly, this means that the grab buckets can also remove the material to be transported without any residue from the bottom, e.g. a hold. When the movable pulley block is now further lifted in the frame, the grab buckets, with their lower boundary edges pressed against each other, will rotate further and the material to be transported will be entirely taken up inside the buckets.

Further particulars of the present invention will now be discussed with reference to the accompanying drawings wherein FIG. 1 shows a grab according to the invention in entirely opened position;

Figure 1:
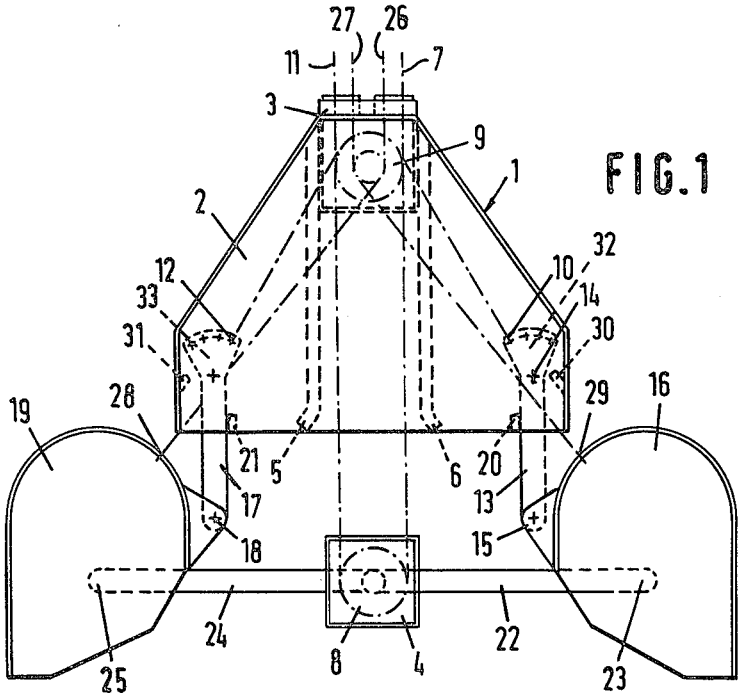

The grab according to the invention comprises substantially a frame or upper structure 1, of which one of the side boundary plates is indicated by 2. Said frame accommodates a stationary pulley block 3, while 4 indicates a pulley block which is movable vertically relative to frame 1 between guides 5 and 6 disposed in the frame therefor. By 7 is indicated a hoisting rope which is conducted over one of the sheaves 9 in the stationary pulley block 3. The end of rope 7 is mounted at 10 in a manner to be described yet on a part in frame 1.

A second hoisting rope 11 runs over one of the pulleys 8 of the movable pulley block 4 and subsequently over one of the sheaves 9 of the stationary pulley block 3, while the end of said hoisting rope, at 12, is secured in a manner to be described yet on a part in frame 1.

At one side of frame 1, at the right-hand side in FIG. 1, there is disposed a set of levers 13 mounted at 14 rotatably in frame 1. Lever 13, on the other end at 15, is mounted pivotally to a lug of the grab bucket 16.

At the left in frame 1 there is disposed a bell crank lever 17 which at 18 is pivotally secured to a lug of grab bucket 19.

The frame accommodates stops 20, 21 for bell crank levers 13, 17 respectively. By 22 is indicated one of a pair of levers having at 23 a pivot point on bucket 16 and on the other end in the centre of the movable pulley block 4.

By 24 is indicated one of a pair of levers which on the one end has a pivot point at 25 on the grab bucket 19 and on the other end in the centre of the movable pulley block 4. Pivot points 23 and 25 lie in a horizontal plane which extends about half the level of the grab buckets 16 and 19, but substantially parallel to the plane lower boundary of said buckets 16 and 19. 26 indicates a rope which via the stationary pulley block 3 extends to point 28 on grab bucket 19.

Another rope 27 runs via stationary pulley block 3 to an attachment point 29 on grab bucket 16.

Figure 2:
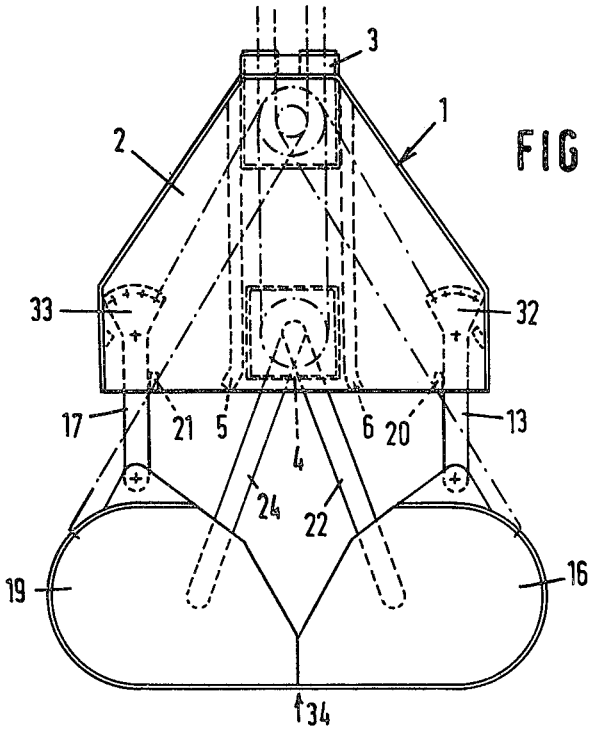
FIG. 2 shows the grab in an intermediate position.
Figure 3:
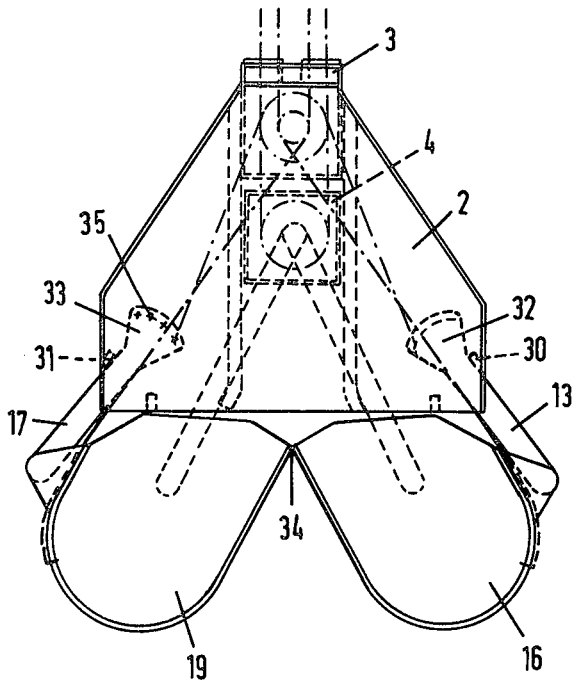
FIG. 3 shows the grab in the entirely closed transporting position of the grab buckets.

Frame 1 furthermore accommodates stops 30 and 31 for bell crank levers 13, 17 respectively (see FIG. 3). By 32 and 33 are indicated the head portions of bell crank levers 13 and 17. By 34 is indicated in FIGS. 2 and 3 the point wherein the lower closing edges of the grab buckets 16 and 19 in an intermediate position of the movable pulley block 4 sealingly adjoin each other in FIG. 2, while said edges, as shown in FIG. 3, continue to be pressed against each other during the further lifting movement of the pulley block 4.

In order to be able to slightly correct the pressure with which the closing edges will abut against each other at 34, there are disposed in the free head ends 32 and 33 of levers 13 and 17 attachment points as indicated by 35 in order to secure the ends 10, 12 of ropes 7 and 11 thereto in different places.

From the opened position as shown in FIG. 1, the grab is lowered onto the material to be transported. Levers 13 and 17 then lie against stops 20, 21, while lever pairs 22 and 24, as shown in FIG. 1, substantially form an angle of 180°. Through the deadweight of the grab as a whole, the buckets are forced to enter the material to be transported to a certain distance. All parts associated with the control remain beyond contact with said material. By lifting the movable block 4 with ropes 7 and 11, the grab buckets 16 and 17 will move to a position as shown in FIG. 2, wherein the lower and side boundary edges sealingly abut against each other, so that it is possible to remove the material to be transported without any residue, e.g. from the bottom of a hold. The closing force with which the lower and side boundary edges contact each other, adapted to the nature of the bulk goods to be transported, can now be adjusted by properly choosing the attachment point of the ends 10 and 12 of ropes 7 and 11, for which purpose, as discussed in the above, a plurality of attachment openings 35 are provided in the free ends 32 and 33 of the bell crank levers 13 and 17. In the position shown in FIG. 2 the movable pulley block 4 lies precisely between guides 5 and 6. When further lifting the pulley block 4, the grab buckets 16 and 19 are further pivoted about their pivot points 15 and 18, whereby the closing edges in point 34 continue to abut against each other. The grab buckets 16 and 19 finally occupy the position shown in FIG. 3. Any chance of spilling and dusting of the material taken up in the grab buckets is now excluded, the more so since said grab buckets substantially abut against frame 1 with their free top sides. In this position the bell crank levers 16 and 17 have arrived in the position shown in FIG. 3 and then lie in abutting engagement against stops 30 and 31.

The pivoting and control points of the grab buckets and the interconnected levers lie in such a place that they come never into contact with the material to be transported. The chance of pollution, distrubances in the control system and spilling of material to be transported is thus avoided.

The unloading of the grab from the position shown in FIG. 3 is effected simply by moving the movable pulley block 4 downwardly, so that the unloading proper can be initiated after the position shown in FIG. 2 is attained and the closing edges are going to move away from each other from point 34. As shown in FIG. 1, the substantially plane bottoms of the grab buckets may be brought substantially in the vertical plane so that it will be certain that the load can be entirely discharged from the grab buckets.

I claim:

1. A grab or the like, substantially comprising a frame or upper structure having a pivoting lever for each grab bucket, at one end of which lever is positioned the pivot point of a grab bucket, each grab bucket being adapted to be brought by means of a rope to the opened position and via a lever system coupled to a pulley block movable in the frame, into the closing position, characterized in that each grab bucket is connected by a lever to a movable pulley block so that in the opened position of the grab buckets the levers are adapted to form an angle of 180°, while the grab buckets, in an intermediate upper position of the movable pulley block, sealingly abut against each other with the lower and side boundary edges and in the uppermost position of the movable pulley block sealingly abut against each other with the lower boundary edges.

2. The grab according to claim 1, characterized in that the pivot point of each lever on each grab bucket is situated in a plane which, extending parallel to the substantially plane bottom of said bucket, extends substantially through the centre of the movable pulley block.

3. The grab according to claim 1 or 2, characterized in that each pivoting lever interconnecting said frame and grab bucket has an adjustable attachment for the closing rope for adjusting the closing force with which the lower and side boundary edges of the grab buckets abut against each other.

* * * * *